United States Patent [19]

Tani

[11] 4,139,298

[45] Feb. 13, 1979

[54] COPYING APPARATUS CAPABLE OF PRODUCING COPIES DIFFERING IN SIZE FROM ORIGINALS

[75] Inventor: Tatsuo Tani, Tokyo, Japan

[73] Assignee: Ricoh Co., Ltd., Japan

[21] Appl. No.: 853,818

[22] Filed: Nov. 21, 1977

[30] Foreign Application Priority Data

Nov. 25, 1976 [JP] Japan ..... 51-140678

[51] Int. Cl.[2] ..... G03G 15/28

[52] U.S. Cl. ..... 355/8; 355/11

[58] Field of Search ..... 355/8, 11, 57-60

[56] References Cited

U.S. PATENT DOCUMENTS

| | | | |
|---|---|---|---|
| 3,432,231 | 3/1969 | Gardner | 355/8 |
| 3,778,147 | 12/1973 | Reehil et al. | 355/11 X |
| 3,901,593 | 8/1975 | Kogiso et al. | 355/11 |

*Primary Examiner*—R. L. Moses

*Attorney, Agent, or Firm*—McGlew and Tuttle

[57] ABSTRACT

The size of a copy to be produced from an original in document copying is changed by moving a lens and mirrors to vary the optical path length of an optical system while keeping the original and a photosensitive element in fixed positions. The lens and the mirrors are moved in a direction in which they intersect the principal light ray simultaneously as they are moved in the direction of the principal light ray, so that one side edge of the copied image of the original can be kept in the same position regardless of the rate at which the original is enlarged or reduced in producing a copy. Thus, it is merely necessary to set the copy sheet in the copy sheet container in such a manner that one side edge of the copy sheet is brought into agreement with a predetermined position, thereby facilitating setting of the copy sheet in document copying.

7 Claims, 7 Drawing Figures

COPYING APPARATUS CAPABLE OF PRODUCING COPIES DIFFERING IN SIZE FROM ORIGINALS

FIELD AND BACKGROUND OF THE INVENTION

This invention relates to copying apparatus, and more particularly to a copying apparatus provided with an optical device capable of varying the rate at which an original is enlarged or reduced in producing a copy of the original in document copying.

In copying apparatus used for document copying, the position in which an original from which a copy is to be illuminated by light rays emanating from a light source and the position in which a photosensitive element is exposed to an optical image of the original are fixed, and an optical device for introducing to the photosensitive element the light rays which have illuminated the original has a complex optical path because it uses a lens and a plurality of mirrors for reflecting the light rays several times, in order to obtain a compact overall size in a copying apparatus. The more complex the optical path, the more complex becomes the construction of the device for varying the rate at which the original is enlarged or reduced in producing a copy or copy size varying device.

SUMMARY OF THE INVENTION

Accordingly, this invention has as its object the provision of a copying apparatus capable of varying the size of a copy to be produced from an original by using an optical device having a complex optical path which has a simple construction and can readily vary the rate at which the original is enlarged or reduced in effecting document copying.

BRIEF DESCRIPTION OF THE DRAWINGS

Additional and other objects, features and advantages of the invention will become apparent from the description set forth hereinafter when considered in conjunction with the accompanying drawings, in which.

DESCRIPTION OF THE PREFERRED EMBODIMENT

The principle of the invention and a preferred embodiment thereof will now be described.

Figure 1:
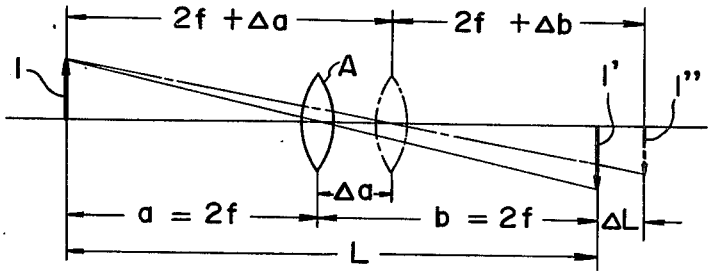
FIGS. 1 and 2 are views in explanation of the principle of the invention showing the relation between the positions of a subject, a lens and an image forming surface when the rate at which the subject is enlarged or reduced is varied, FIG. 1 showing a principal light ray in agreement with the optical axis of the lens, and FIG. 2 showing a principal light ray being inclined with respect to the optical axis of the lens.

Referring to FIG. 1, when an image of a subject l, for example the surface of an original, is formed on an image forming surface l', for example a photosensitive element, by means of a lens A with a focal distance f, $a = b = 2f$ when a copy to be produced from an original is equal in size to the original. In this case, a is the distance between the subject l and the lens A, and b is the distance between the lens A and the image forming surface l'. Therefore, $(1/a) + (1/b) = (1/f)$.

Let us consider changes in the positions of the elements which will occur when the copy size or the rate of magnification or reduction are varied, by using as a reference the relative positions of the element when a copy equal in size to an original is produced. If the lens A is moved for a distance Δa to a dash-and-dot line position and the distance between the lens A and the image forming surface l'' is 2f = Δb at that time, $$\frac{1}{2f + \Delta a} + \frac{1}{2f + \Delta b} = \frac{1}{f}$$

$$\text{magnification } m = \frac{2f + \Delta b}{2f + \Delta a}$$

$$\Delta a = \left(\frac{1}{m} - 1\right) f$$

$$\Delta b = (m - 1) f$$

The amount of displacement ΔL from the position of the image forming surface l provided in producing a copy equal in size to an original to the image forming surface l'' can be expressed by the following formula:

$$\Delta L = \Delta a + \Delta b = \left(m + \frac{1}{m} - 2\right) f$$

In a slit exposing device, the light rays used are such that the principal light ray incident on the lens is not in agreement with the optical axis of the lens in many cases. More specifically, the light rays used in many cases are such that the principal light ray is inclined by an angle $\theta$ with respect to the optical axis.

If the distances between the subject and the lens, between the lens and the image forming surface, and between the image forming surfaces l' and l'', which are denoted by Δa, Δb and ΔL, are denoted by Δa', Δb' and ΔL' respectively when inclined light rays are used, $$\Delta a' = \Delta a/\cos\theta_o = \left(\frac{1}{m} - 1\right) f/\cos\theta_o$$

$$\Delta b' = \Delta b/\cos\theta_o = (m - 1) f/\cos\theta_o$$

$$\Delta L' = \Delta L/\cos\theta_o = \left(m + \frac{1}{m} - 2\right) f/\cos\theta_o$$

Thus, the directions of movements of various elements are the same as the direction of the principal ray which is inclined by an angle $\theta$ with respect to the optical axis of the lens.

There are three methods available in varying the rate of magnification or reduction of an image to be formed from an original. They are as follows:

(a) The first method consists in moving the lens A for a distance Δa (or Δa') while keeping the position of the subject stationary, and the overall length of the path between the position of the subject and the image forming surface is varied by ΔL (or ΔL') by moving the image forming surface or moving the mirrors arranged between the image forming surface and the lens.

(b) The second method consists in moving the position of the subject or the mirrors arranged between the position of the subject and the lens while keeping the lens stationary to change the distance between the subject and the lens by Δa (or Δa'), and moving the image forming surface or the mirrors arranged between the image forming surface and the lens to change the distance between the lens and the image forming surface by $\Delta b$ (or $\Delta b'$).

(c) The third method consists in moving the lens while keeping the image forming surface stationary to change the distance between the lens and the image forming surface by $\Delta b$ (or $\Delta b'$), and moving the position of the subject or the mirrors arranged between the subject and the lens to change the distance between the position of the subject and the lens, so as to change the overall length of the path between the position of the subject and the image forming surface by $\Delta L$ (or $\Delta L'$).

In copying apparatus, simplification of the construction makes it necessary to fix the position of the subject and the image forming surface. Therefore, of all the methods (a), (b) and (c) summarized above, the method wherein the mirrors arranged between the subject and the image forming surface are moved without moving the position of the subject and the image forming surface is preferable for changing the rate of magnification or reduction or changing the size of a copy to be produced from an original.

The amounts of movements of various elements when different elements are moved in effecting a change in the rate of magnification or reduction can be expressed by the following formulas:

When the movement of the elements are effected along the optical axis of the lens, $$\Delta a = -\frac{f \cdot \Delta b}{\Delta b + f} \text{ or } \Delta b = -\frac{f \cdot \Delta b'}{\Delta a + f}$$

$$\Delta L = -\frac{(\Delta a)^2}{a + f} \text{ or } \Delta L = \frac{(\Delta b)^2}{\Delta b + f}$$

When the movements of the elements are effected along the principal light rays inclined with respect to the optical axis of the lens, $$\Delta a' = \frac{f \cdot \Delta b'}{\Delta b' + f} \text{ or } \Delta b' = -\frac{f \cdot \Delta a'}{\Delta a' + f}$$

$$\Delta L' = \frac{(\Delta a')^2}{\Delta a' + f} \text{ or } \Delta L' = \frac{(\Delta b')^2}{\Delta b' + f}$$

Therefore, if various elements of the optical system are moved in a manner to satisfy the abovementioned relations, then it is possible to freely and positively effect a change in the size of a copy to be produced from an original or a change in the rate of magnification or reduction and to obtain a clear image formed on the image forming surface.

When a copy to be produced from an original by using a copying apparatus is equal in size to the original, positioning of copy sheets can be readily carried out because copying sheets can have a predetermined uniform size. However, when it becomes possible to obtain copies of different sizes which differ from the size of an original in document copying, copy sheets of different sizes should be used because images of different sizes can be produced from the same original. Generally, the position of the optical axis or the principal light ray of an optical system is constant, so that the central position of each copy sheet is constant at all times. Therefore, it becomes necessary to effect positioning of copy sheets of different sizes by using their center as a reference. In actual practice, however, a difficulty is encountered in effecting positioning of copy sheets by using their center as a reference. Thus, it is common practice to put marks on the copy sheet container in positions each corresponding to one side edge of copy sheets of different sizes and to place copy sheets in the copy sheet container in such a manner that their side edges are in agreement with the mark for the particular size of the copy sheets. However, when there are many different sizes of copy sheets, marks of a correspondingly large size will be required. This may give rise to the danger of the operator making an error in positioning the copy sheets.

Under these circumstances, it is preferable from the point of view of increasing operational efficiency that copy sheets can be positioned correctly by using one mark as a reference regardless of a variation in the size of the copy sheets. When this system can be adopted, the position of one side edge of the copy sheets relative to the photosensitive element becomes constant irrespective of the size of the copy sheets used. Thus the adoption of this system offers an additional advantage in that there is increased latitude in selecting a desired copy sheet separating process because a process of utilizing one side edge of the copy sheet for separating a copy sheet from the photosensitive element can be used. In order that this system may be adopted, it is necessary to displace the optical axis or principal light ray incident on the lens with respect to the image forming surface when the rate of magnification or reduction is changed. That is, in effecting a change in the rate of magnification or reduction, lens and other elements must be moved in a direction which intersects the direction of the optical axis or the principal light ray simultaneously as they are moved in the direction of the optical axis or the principal light ray.

Figure 2:
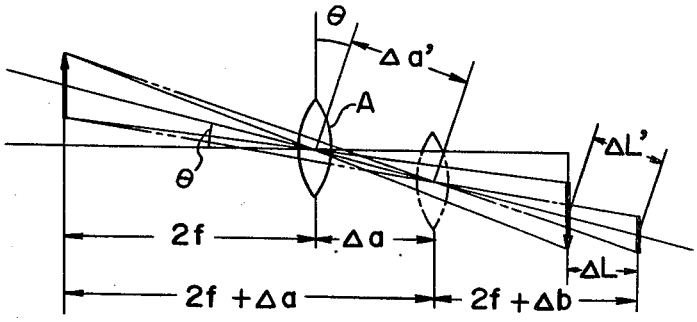
Figure 3:
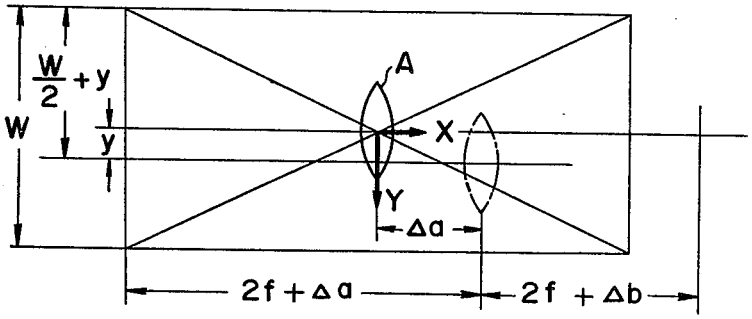
FIG. 3 is a plan view of FIG. 1 or FIG. 2.

In FIG. 3 which is a top plan view of the optical system shown in FIG. 1 and FIG. 2, the lens A is moved for a distance $\Delta a$ in the same direction as the optical axis X, and at the same time the lens A is moved for a distance y in a direction Y which is normal to the optical axis X. If the maximum width of the copy to be produced at this time is denoted by W, the following relation holds:

$$\frac{\frac{W}{2} - y}{\frac{W}{2} + y} = m \text{ (magnification)}$$

Therefore, $$y = \frac{1 - m}{1 + m} \cdot \frac{W}{2}$$

The relation between y and $\Delta a$ can be expressed by the following formula:

$$y = \frac{\Delta a}{\Delta a + 2f} \cdot \frac{W}{2}$$

When the lens A is moved in a direction in which it is inclined by an angle $\theta$ with respect to the optical axis, $$y = \frac{\Delta a \cos\theta}{\Delta a' \cos\theta + 2f} \cdot \frac{w}{2}$$

The present invention is directed to enabling the rate of magnification or reduction to be varied in document copying by moving the lens and other elements of an optical system both in the same direction as the optical axis or the direction of the principal light ray incident on the lens and in a direction which intersects the optical axis in accordance with the above-described principle. Production of copies differing in size from originals can be effected according to the invention by effecting the positioning of copy sheets in such a manner that the side edge of each copy sheet is brought into agreement with one reference. One embodiment of copying apparatus in conformity with the present invention which is capable of producing a copy from an original by changing the rate of magnification or reduction will now be described. It is to be noted that, in case a change in the rate of magnification or recuction is effected to produce a copy differing in size from an original by bringing one side of a copy sheet, not the center thereof, into agreement with a reference when the distribution of light illuminating the original or the amount of light in the vicinity of the image forming surface is not uniform in the Y-direction in producing a copy of the same size as an original, there are possibilities that the amount of light incident on the image forming surface becomes unbalanced and variations in the amount of light to which the image forming surface is exposed exceed acceptable tolerances. Thus it becomes necessary to provide means for effecting adjustments of the amount of light.

Figure 4:
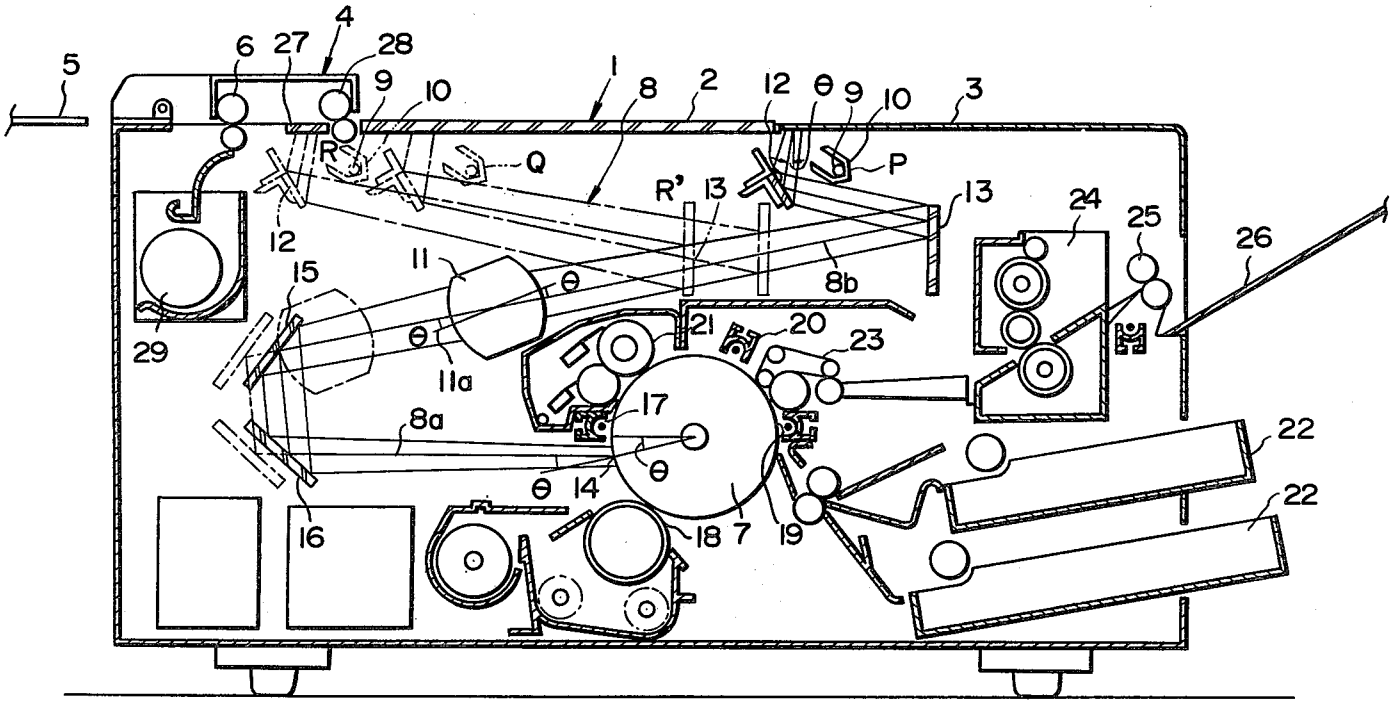
FIG. 4 is a schematic sectional view of a copying apparatus using the optical device in accordance with the present invention.

In FIG. 4, a first contact glass plate 2, serving as means for supporting an original from which a copy is to be produced, is secured to a machine frame 3 at a first original placing station 1. An original which is bulky as in the form of a book (hereinafter referred to as a book original) can be supported on the contact glass plate 2.

At a second original placing station 4, there are provided an original supporting table 5, and an original supporting device comprising a pair of original feed rollers 6, 6 and a second contact glass plate 27.

An optical device 8 for projecting light rays onto an original and forming an optical image of the original on a photosensitive element or a photosensitive drum 7, for example, comprises original illuminating means comprising a light source 9 and a reflecting member 10 for reflecting the light emanating from the light source 9 so as to effect slit illumination of the original, a through Lens 11, a first mirror 12 and a second mirror 13 for reflecting toward the through lens 11 the light rays that have scanned the original, and a third mirror 15 and a fourth mirror 16 for reflecting the light rays that have passed through the through lens 11 and directing such light rays toward an exposing position 14 on the photosensitive drum 7.

The photosensitive drum 7 is charged, as usual, by means of a charger 17, has an electrostatic latent image formed in the exposing position 14 as the exposing position 14 is exposed to an optical image of the original, has such electrostatic latent image developed by means of a developing device 18, has a developed image printed by transfer printing on a copy sheet at a transfer-printing position 19, has the electric charge removed by means of an electric charge removing device 20, and has its peripheral surface cleaned by means of a cleaning device 21. This cycle of operation is repeated.

Each copy sheet supplied from containers 22 has a visible image printed thereon by transfer printing in the transfer-printing position 19 of the photosensitive drum 7 and delivered to a fixing device 24 by a delivery means 23. After having the printed image fixed by the fixing device 24, each copy sheet is ejected by delivery rollers 25, 25 onto a printed copy sheet tray 26.

The light source 9, reflecting member 10 and first mirror 12 of the optical device are mounted on a common support and moved as a unit in reciprocatory movement between an illumination standby position P (the position shown in solid lines in FIG. 2) of the first original placing station 1 and an illumination terminating position Q (the position shown in dash-and-dot lines in FIG. 2) thereof for scanning an original placed in the first original placing station 1. At this time, the second mirror 13 moves synchronously with the first mirror 12 in reciprocatory movement in the same direction at a suitable speed or at a speed which is one half the speed of the first mirror 12, for example. This keeps constant the optical path length from the first mirror 12 to the lens 11.

When an original placed in the second original placing station 4 is illuminated, the light source 9, reflecting member 10 and first mirror 12 move to a dash-and-dot line position R. At this time, the second mirror 13 moves to a position R'.

In scanning a book original placed at the first original placing station 1, the light source 9, reflecting member 10, first mirror 12 and second mirror 13 are moved in reciprocatory movement while the original remains stationary. However, when an original in sheet form (hereinafter referred to as a sheet original) is scanned at the second original placing station 4, the light source 9, reflecting member 10, first mirror 12 and second mirror 13 are fixed at the positions R and R', and the original is moved by means of the feed rollers 6, 6. The original fed by the feed rollers 6, 6 is illuminated by light as it moves on the second contact glass plate 27 which is exposed to light rays emanating from the light source 9 disposed in the position R. The illuminated sheet original is ejected onto the first contact glass plate 2 by means of a pair of delivery rollers 28, 28.

The light rays thrown upon the original placed on the first contact glass plate 2 or second contact glass plate 27 are reflected by an optical device 8 and projected onto the photosensitive drum 7 which is exposed to an optical image of the original to form an electrostatic latent image thereon.

In order to obtain a compact overall size in a copying apparatus by using no more space than is absolutely necessary, the exposing position on the photosensitive drum 7 can be selected such that a principal light ray **8*a* of the optical device 8 is not in agreement with the line connecting the exposing position and the center of the photosensitive drum and is inclined by an angle $\theta$ as shown in FIG. 4. When this is the case, the lens 11 is preferably arranged such that its optical axis 11*a* is inclined by an angle with respect to the direction 8*b* of the principal light ray of the light incident on the optical device 8 in order to avoid distortion of an image formed on the photosensitive drum 7**.

A blower 29 is provided to cool the second contact glass plate 27 because the latter is heated by the light thrown thereupon by the stationary light source.

In carrying out document copying, it is common practice to produce a copy of a size which is equal to the size of an original. However, when it is required to produce a copy from an original in a reduced size, the ratio of the optical path length between the lens 11 and the original to the optical path length between the lens 11 and the photosensitive drum 7 is varied by moving the lens 11, third mirror 15 and fourth mirror 16. When a copy of a reduced size is produced from an original, the original is usually in the form of a sheet original.

When it is desired to produce a copy of a reduced size from a book original, a copy of the book original can be used as a sheet original for producing a copy of a reduced size. Therefore, the copying apparatus has only to have a construction such that a change in the rate of magnification or reduction can be effected with respect to a sheet original so that a copy differing in size from an original can be produced.

Figure 5:
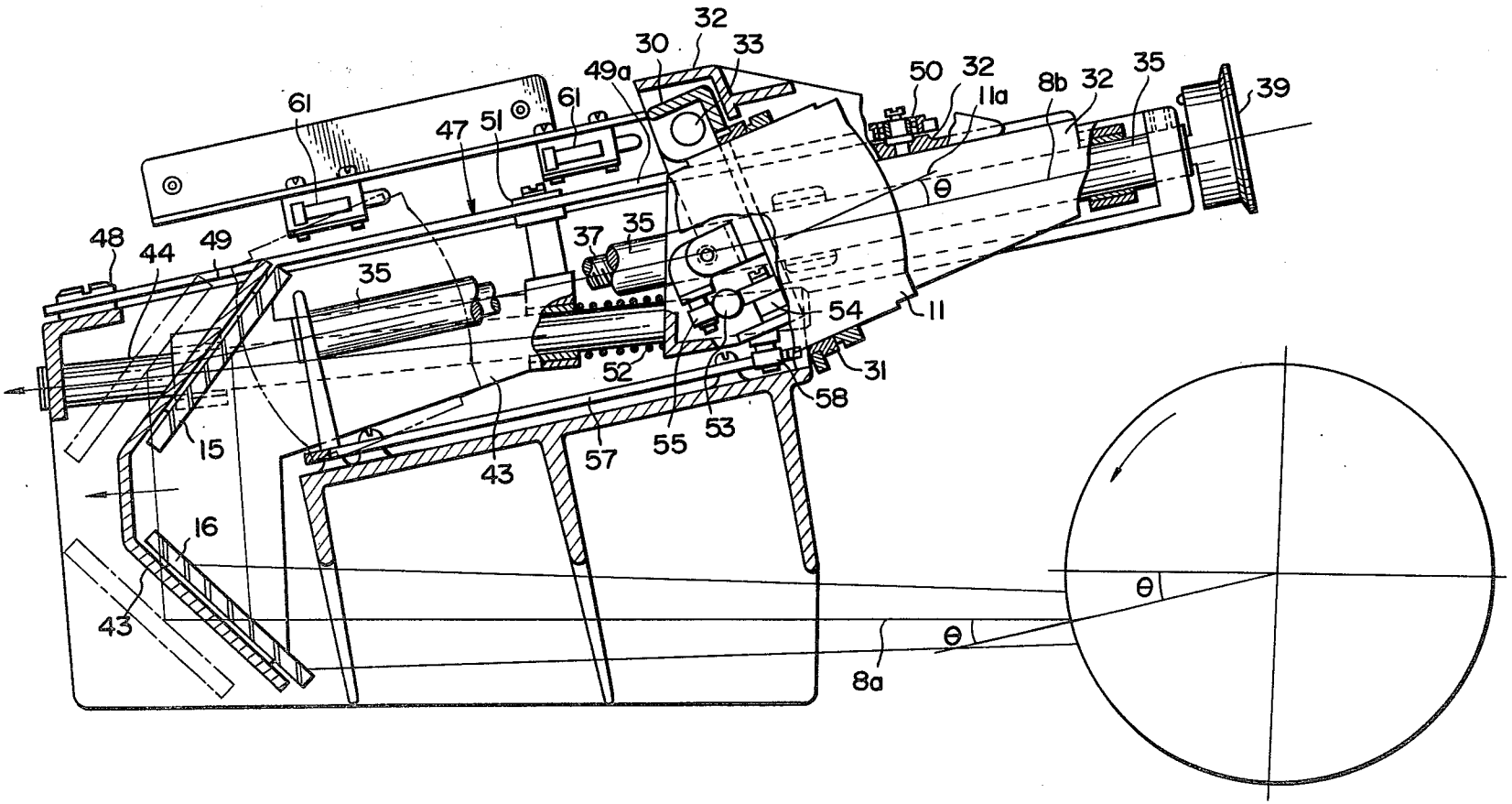
FIG. 5 is a fragmentary sectional view of the copy size varying device for moving the lens and the mirrors.
Figure 6:
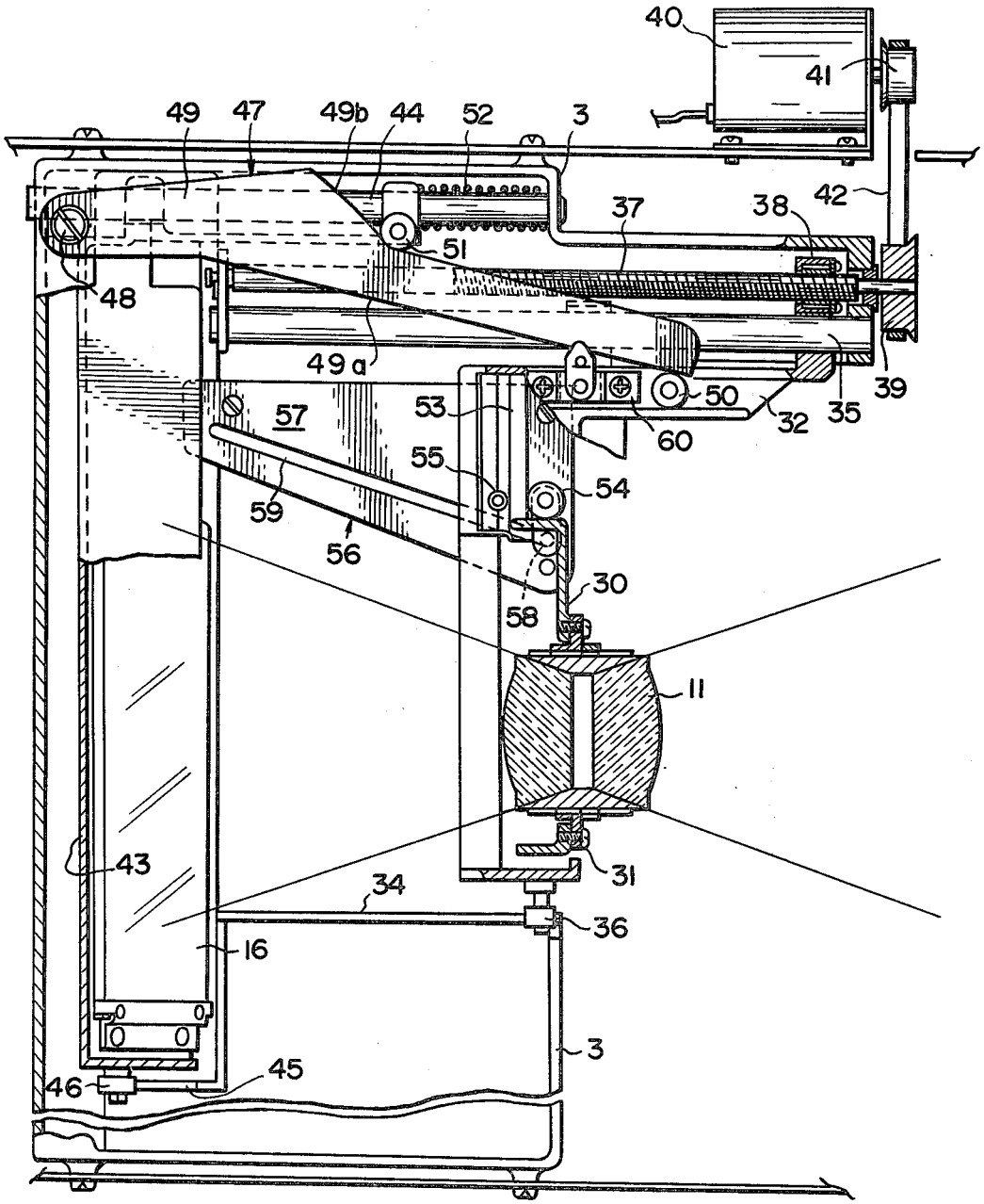
FIG. 6 is a plan view of the copy size varying varying device.

Referring to FIGS. 5 and 6, the lens 11 is secured to a lens base 31 mounted on a first lens bracket 30 which is supported for movement in a direction perpendicular to the optical axis of the lens 11 by means of a guide rod 33 secured to a second lens bracket 32. The second guide bracket 32 is guided by a guide 34 secured to the machine frame 3 for movement in the direction 8*b* of the principal light ray 8*a* which is inclined by an angle $\theta$ with respect to the optical axis 11*a* as shown in FIG. 4.

The first lens bracket 30 supporting the lens 11 can move together with the second lens bracket 32 in a direction parallel to the direction 8*b* of the principal light 8*a*, and the first lens bracket 30 can move singly in a direction perpendicular to the optical axis 11*a*.

The second lens bracket 32 is guided by an X-direction guide rod 35 secured to the machine frame 3 for sliding movement in a direction parallel to the direction 8*b* of the principal light ray 8*a*, and inclination of the second lens bracket 32 is prevented by means of a roller 36 moving in rolling movement on the guide 34.

The second lens bracket 32 supports a nut 38 threadably engaging a feed screw 37 rotatably supported by the machine frame 3, so that the second lens bracket 32 is moved axially of the feed screw 37 together with the nut 38 as the feed screw 37 rotates. The nut 38 is supported by the second lens bracket 32 in such a manner that it can move freely in a radial direction but is prevented from moving in an axial direction by taking into concideration the deflection of the feed screw 37 or misalignment of the center line thereof, so that the movement of the second lens bracket 32 by means of the feed screw 37 can be effected with a high degree of precision. Secured to one end of the feed screw 37 is a pulley 39 which is drivingly connected through a belt 42 to a pulley 41 mounted on a drive motor 40. Upon actuation of the drive motor 40, the feed screw 37 is rotated either in the normal direction or in the reverse direction, thereby moving the second lens bracket 32 either in the normal direction or in the reverse direction. The feed screw 37 functions as a means for driving the lens 11 to move the same.

A mirror bracket 43 having secured thereto the third mirror 15 and fourth mirror 16 is guided by a mirror guide rod 44 secured to the machine frame 3 for sliding movement in a direction which is inclined by a certain angle with respect to the direction of movement of the lens 11. A roller 46 adapted to move in rolling movement on a mirror guide 45 is effective to prevent inclination of the mirror bracket 43.

The direction of movement of the mirror bracket 43 is set such that the position in which light rays are incident on the photosensitive drum 7 does not undergo a change even if the mirrors 15 and 16 move. More specifically, the standard practice is to set the direction of movement of the mirror bracket 43 at a direction parallel to the bisector of the angle formed by the principal light ray 8*b* incident on the lens and the principal light ray 8*a* thrown upon the photosensitive drum 7.

In varying the rate of magnification or reduction or producing a copy from an original in a size which differs from the size of the original, the relation between the amount of movement of the lens 11 and the amount of movement of the mirrors 15 and 16 must be constant as explained with reference to the principle of the invention. To keep this relation constant, a cam device 47 is provided in the present invention and operates to convert the amount of movement of the lens 11 into a rotational angle so as to determine the amount of movement of the mirrors 15 and 16 in accordance with this rotational angle.

The cam device 47 comprises a cam plate 49 pivotally supported by the machine frame 3 through a fixed shaft 48, a main roller 50 supported by the second lens bracket 32, and a follower roller 51 supported by the mirror bracket 43. The main roller 50 is maintained in contact with a first cam surface 49*a* of the cam plate 49, while the follower roller 51 is maintained in contact with a second cam surface 49*b* thereof. It is to be understood that the cam surfaces may be replaced by cam grooves.

The first cam surface 49*a* is contoured such that it is straight, for example, so that the cam plate 49 will move in pivotal movement in proportion to the amount of movement of the lens 11 as the lens 11 and hence the second lens bracket 32 moves. This enables the movement of the lens 11 to be determined in terms of the angle of pivotal movement of the cam plate 49. It is to be understood that the first cam surface 49*a* is not limited to the aforesaid contours and that the shape of the first cam surface 49*a* can be determined as desired depending on the need.

The follower roller 51 moves axially of the mirror guide rod 44 along the second cam surface 49*b* in accordance with the angle of pivotal movement of the cam plate 49. That is, the mirror bracket 43 and the mirrors 15 and 16 move together with the follower roller 51 along the mirror guide rod 44. By selecting suitable contours for the first and second cam surfaces 49*a* and 49*b*, it is possible to keep the relation between the amount of movement of the lens 11 and the amount of movement of the mirrors 15 and 16 within a predetermined range.

A spring 52 is mounted on the mirror guide rod 44 to press the follower roller 51 against the second cam surface 49*b* by its biasing force so that the mirror bracket 43 may positively follow the movement of the cam plate 49. It is to be understood that the position in which the spring 52 is mounted is not limited to the position shown in FIG. 6 and described hereinabove, and that the spring 52 may be mounted in any position as desired so long as the spring 52 is capable of pressing by its biasing force the follower roller 51 against the second cam surface 49*b*.

In order that the lens 11 may be moved in the direction of the principal light ray 8*b* and at the same time in a direction perpendicular to the optical axis, the first lens bracket 30 supporting the lens 11 is supported by the guide rod 33 in such a manner that the first lens bracket 30 is movable relative to the second lens bracket 32. A guide roller 54 and a pressure applying roller 55 are arranged in a manner to hold therebetween a guide 53 secured to the second lens bracket 32, so as to prevent inclination of the first lens bracket 30.

A lens guide cam device 56 is provided for moving the lens 11 in a direction perpendicular to the optical axis in an amount which is maintained in a predetermined relation to the amount of movement of the lens 11 in the direction of the principal light ray 8*b* in accordance with the principle referred to hereinabove. The lens cam device 56 comprises a cam plate 57 secured to the machine frame 3, and a cam follower 58 mounted on the first lens bracket 30. The cam plate 57 is formed therein with a cam groove 59 of a shape which is in conformity with the formulas representing the amounts of movement of the lens 11 in the direction of the principal light ray or an X-direction and in a direction perpendicular to the optical axis or a Y-direction. If the first lens bracket 30 and hence the lens 11 move in the X-direction, then the cam follower 58 is guided by the cam groove 59 to move in a direction perpendicular to the optical axis. This moves the first lens bracket 30 and hence the lens 11 in the Y-direction.

With the aforesaid construction, if the lens 11 moves in the X-direction, then the lens 11 also moves automatically in the Y-direction, and the third and fourth mirrors 15 and 16 also move while being maintained in predetermined relation to the lens 11.

Thus it will be appreciated that if the rate of magnification or reduction or the size of a copy to be produced from an original is selected beforehand, it is possible to cause the lens 11 and the mirrors 15 and 16 to automatically stop in positions which are commensurate with the selected rate of magnification or reduction. More specifically, a switch actuator 60 is mounted on the second lens bracket 32, and a switch, such as a microswitch 61, is mounted on the machine frame 3 so as to be actuated by the switch actuator 60 when the lens 11 has reached a position which corresponds to the selected rate of magnification or reduction. In case it is desired to select a rate of magnification or reduction from over two rates of magnification or reduction, over two switches 61 are provided.

Figure 7:
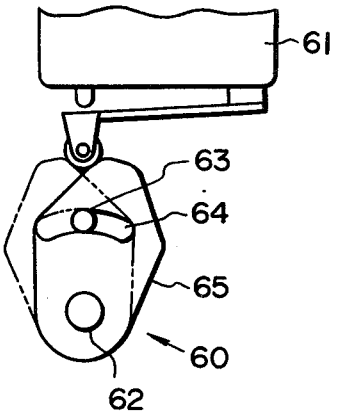
FIG. 7 is a view in explanation of a switch actuator.

If a rate of magnification or reduction is selected as by pressing a button on the control panel of the copying apparatus, the drive motor 40 stops operating when the particular switch 61 corresponding to the selected rate of magnification is actuated by the actuator 60, thereby positioning the lens 11.

Where over two rates of magnification or reduction are provided for selecting the size of a copy to be produced from an original in document copying, the switch actuator 60 may move past the switches 61 and the direction in which the switch actuator 60 acts on one of the switches 61 is not limited to one direction. If the switch actuator 60 can actuate any one of the switches 61 by moving both from its right side and from its left side in FIG. 5, there are possibilities that there will arise a variation in the position in which the switch actuator 60 engages the switch 61. To avoid this problem, the switch actuator 60 comprises an actuator element 65 pivotally supported by a pin 62 and formed therein with a slot 64 for receiving therein a fixed pin 63 as shown in FIG. 7. The angle through which the actuator element 65 can rotate is limited by the slot 64. If the positions in which the actuator element 65 reaches the ends of its pivotal movements to right and left about the pin 62 as restricted by the size of the slot 64 are set to correspond to the positions in which the actuator 60 actuates the contact of any one of the switches 61, then the switch actuator 60 actuates the contact of one switch 61 when the former moves from the right side in FIG. 7 and the other switch when it moves from the left side in the figure. Although the position of the actuator element 65 may vary, the position of the pin 62 for pivotally supporting the actuator element 62 is constant. Thus it is possible for the switch actuator 60 to actuate the switch 61 in a predetermined position no matter from what direction the second lens bracket 32 may approach the switch 61.

It is to be understood that the positioning of the lens 11 is not limited to the aforementioned method, and that any other suitable method may be used to accomplish the object. For example, a pulse motor may be used as the drive motor 40 and the angle of rotation of the motor is regulated by the number of pulses, or a servomotor may be used along with a position detecting device and a setting device associated therewith. By selecting a suitable lens positioning device and a suitable original scanning speed varying device, it is possible to effect infinitely variable alteration of the rate of magnification or reduction of a copy to be produced from an original in document copying.

In the embodiment of the invention shown in FIGS. 5 and 6, it is possible to effect a change in the rate of magnification of a copy to be produced from an original in document copying by using a simple device wherein the lens and the mirrors are moved while the position of the subject or the surface of the original and the image forming surface or the exposing position in the photosensitive drum remain stationary. A change in the magnification or reduction rate can be effected automatically, and copy sheets can be positioned by bringing their one side edge into agreement with a single mark regardless of the sizes of copies to be produced from an original, thereby facilitating positioning of the copy sheets.

If the optical device is constructed such that the light source 9, reflecting member 10 and first mirror 12 are moved as a unit and the second mirror 13 is moved separately, it is possible to effect scanning of a fixed original by moving the light source and mirrors in reciprocatory movement, so that a book original can be copied in the fixed position. Moreover, if the light source, its reflecting member and the first mirror and the second mirror are constructed such that they can be driven by the same driving to move in reciprocatory scanning movement into and from the second original placing station by exceeding the scanning stroke and can be held in position in the second original placing station, it is possible to change the rate of magnification or reduction in producing a copy from an original by switching between the two different positions for illuminating the original. If the production of a copy differing in size from an original can be effected by switching between the two positions for illuminating the original, it is possible to vary the position in which a book original is copied from the position in which a sheet original is copied. This makes it possible to produce a copy of a sheet original while the latter is being fed by the pair of feed rollers, so that no limits are placed on the length of a sheet original to be copied and a copy can therefore be produced from a sheet original of a very great length.

In changing the rate of magnification or reduction or the size of a copy to be produced from an original in document copying, it is necessary that the original scanning speed, i.e. the original feeding speed or the illumination device moving speed, can be automatically varied in accordance with a rate at which the size of a copy to be produced is enlarged or reduced as compared with the size of an original, because the rotational speed of the photosensitive drum is constant. It is to be understood that the rotational speed of the photosensitive drum can be varied while keeping the original scanning speed constant.

If the rotational speed of the photosensitive drum can be varied in accordance with a change in the rate of magnification or reduction of a copy to be produced from an original, it is possible to vary the rate of magnification or reduction of a book original placed in the first original placing station and a sheet original placed in the second original placing station while keeping the original scanning speed constant.

In the embodiment shown and described hereinabove, copy sheets of the same size are being shown and described to be fed to the photosensitive drum. It is to be understood that a copy sheet in roll form can be used in the present invention.

The present invention provides a copying apparatus capable of producing a copy of a size different from the size of an original which is simple in construction and easy to operate.

While a specific embodiment of the invention has been shown and described in detail to illustrate the application of the principles of the invention, it will be understood that the invention may be embodied otherwise without departing from such principles.

What is claimed is:

1. A copying apparatus capable of producing copies differing in size from originals comprising:
- original support means;
- original illuminating means;
- a photosensitive element operable to have an image of an original formed thereon;
- a lens for forming an image of an original on said photosensitive element;
- at least one mirror reflecting light rays emerging from said lens toward said photosensitive element;
- drive means for moving said lens;
- converting means operable to convert the amount of movement of said lens into an angle of rotation;
- mirror moving means operable to move said at least one mirror in accordance with said angle of rotation;
- means for rendering said drive means inoperative when the amount of movement of said lens has reached a limit commensurate with a desired rate of magnification; and
- means operable to vary one of the speed at which the original is scanned and the rotational speed of said photosensitive element in accordance with a selected rate of magnification in effecting document copying.

2. A copying apparatus as claimed in claim 1, including a lens bracket supporting said lens and mounted for movement in the direction of a principal light ray incident on the lens and in a direction intersecting the direction of the principal light ray.

3. A copying apparatus as claimed in claim 1, wherein said converting means comprises a bracket supporting said lens, a roller mounted on said bracket, a cam plate having a cam surface engaged by said roller, and a fixed shaft pivotally supporting said cam plate; said cam surface of said cam plate extending obliquely with respect to the direction of movement of said roller.

4. A copying apparatus, as claimed in claim 3, including a cam device operatively connected to both said converting means and said mirror moving means.

5. A copying apparatus, as claimed in claim 4, wherein said cam device comprises a further cam surface formed in said cam plate of said converting means; and a cam follower, constituted by a roller, operatively engaging said further cam surface and mounted on said at least one mirror.

6. A copying apparatus, as claimed in claim 1, wherein said means for rendering said drive means inoperative comprises a switch actuator means; a bracket on said lens supporting said switch actuator means; said copying apparatus including a machine frame; at least one limit switch means mounted on said machine frame in a position corresponding to the position to which said lens should be moved in accordance with a desired rate of magnification or reduction; said switch actuator means comprising an actuator element; a pin pivotally supporting said actuator element; and means limiting pivotal movement of said actuator element to a predetermined angular range; said actuator element being operable to actuate said limit switch means irrespective of which side of said actuator element is brought into contact with said limit switch means.

7. A copying apparatus as claimed in claim 2, further comprising cam means operable to move said lens bracket in a direction intersecting the direction of the principal light ray by a predetermined amount in accordance with the movement of the lens bracket in the direction of the principal light ray.

* * * * *